US005111580A

United States Patent [19]

Bosscha et al.

[11] Patent Number: 5,111,580

[45] Date of Patent: May 12, 1992

[54] ELECTRIC SHAVING APPARATUS

[75] Inventors: Geert J. Bosscha; Andries C. Pasma, both of Drachten, Netherlands

[73] Assignee: U.S. Philips Corp., New York, N.Y.

[21] Appl. No.: 622,665

[22] Filed: Dec. 5, 1990

[30] Foreign Application Priority Data

Dec. 14, 1989 [NL] Netherlands ..... 8903065

[51] Int. Cl.[5] ..... B26B 19/44; B26B 19/48; H01H 9/00; H01H 9/18

[52] U.S. Cl. ..... 30/41.7; 30/41.6; 200/308; 200/316

[58] Field of Search ..... 30/41, 41.6, 41.7, DIG. 1, 30/DIG. 2; 200/52, 308, 316

[56] References Cited

U.S. PATENT DOCUMENTS

| | | | |
|---|---|---|---|
| 3,803,372 | 4/1974 | Dijkstra | 30/DIG. 1 |
| 4,112,271 | 9/1978 | Marchetti | 30/DIG. 1 |
| 4,354,080 | 10/1982 | Murmann | 200/316 |
| 4,359,618 | 11/1982 | Stevens | 200/308 |
| 4,384,180 | 5/1983 | Meijer et al. | 200/308 |
| 4,583,151 | 4/1986 | Nagel | 200/316 |
| 4,847,996 | 7/1989 | Blykharov | 30/41.6 |

*Primary Examiner*—Douglas D. Watts
*Assistant Examiner*—Paul M. Heyrana, Sr.
*Attorney, Agent, or Firm*—Ernestine C. Bartlett

[57] ABSTRACT

An electric shaving apparatus is provided which comprises a housing, a switch for activating switching cycles in which the apparatus is switched on and off, a holder for at least one external shaving member with hair-entry apertures, and an internal shaving member adapted to be driven by the external shaving member, the housing having a collecting space for shaving particles, which collecting space has a closing member with a locking mechanism, which locking mechanism comprises an actuating member, the apparatus comprising means for counting the number of switching cycles and a signalling device for signalling that cleaning of the collecting space is desirable in response to a predetermined or selected number of switching cycles. The signalling device comprises a light-emitting element in combination with the actuating member.

16 Claims, 1 Drawing Sheet

ELECTRIC SHAVING APPARATUS

BACKGROUND OF THE INVENTION

The invention relates to an electric shaving apparatus having a housing, a holder for at least one external shaving member with hair-entry apertures, and an internal shaving member adapted to be driven by the external shaving member, the housing having a collecting space for shaving particles, which collecting space has a closing member with a locking mechanism, which locking mechanism comprises an actuating member, the apparatus also comprising a signalling device for signalling that cleaning of the collecting space is desirable.

Such a shaving apparatus is known, for example from Japanese Patent 60-3505. In said Patent the number of times that the apparatus is switched on is taken as a measure of the degree of soiling of the collecting space. After an adjustable number of turn-on cycles the counting mechanism supplies a signal to activate an alarm system.

SUMMARY OF THE INVENTION

An object of the invention is to provide a shaving apparatus having such a signalling device, requiring a minimal number of additional parts and enabling the production costs to be minimized.

The invention is characterized in that the signalling device comprises a light-emitting element in combination with the actuating member.

In this way an element which is already present, i.e. the actuating member, is utilized for the signalling element, so that the design of the apparatus is not affected by the signalling device.

Moreover, by the association of the actuating member with the collecting space, the purpose of the signal, i.e. indicating that cleaning of the collecting space is desirable, will be immediately evident and no confusion will be possible with, for example a signal indicating that the batteries powering the apparatus are exhausted.

In special embodiments of the invention, the light-emitting element is arranged in the actuating member; and/or the light-emitting element is coupled to the actuating member by means of an optical guide element; and/or the actuating member is at least partially light-transmitting; and/or the actuating member is at least partially light-diffusing; and/or the actuating member is provided with a symbol relating to cleaning, for example a brush; and/or the actuating member is provided with a text related to cleaning, for example the word "dust"; and/or the light-emitting element is a LED.

An embodiment of the invention will now be described in more detail, by way of example, with reference to the Figures.

DETAILED DESCRIPTION OF THE PREFERRED EMBODIMENTS

Figure 1:
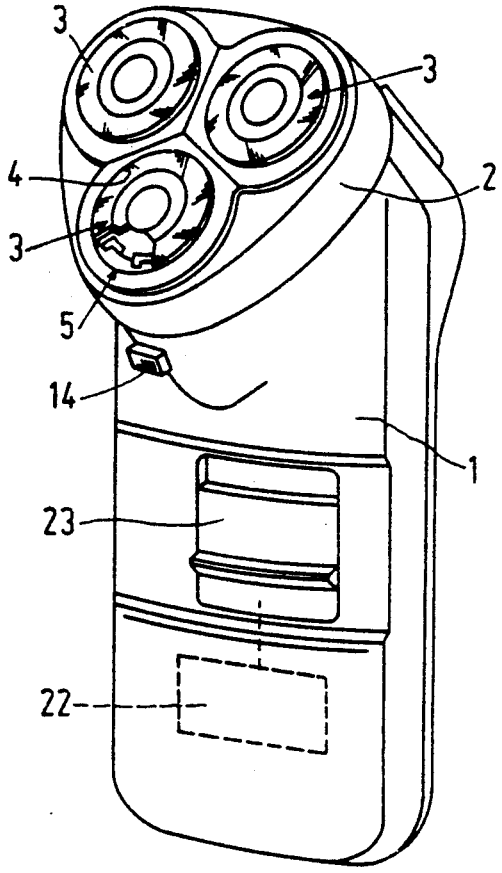
FIG. 1 is a perspective view of a shaving apparatus.
Figure 2:
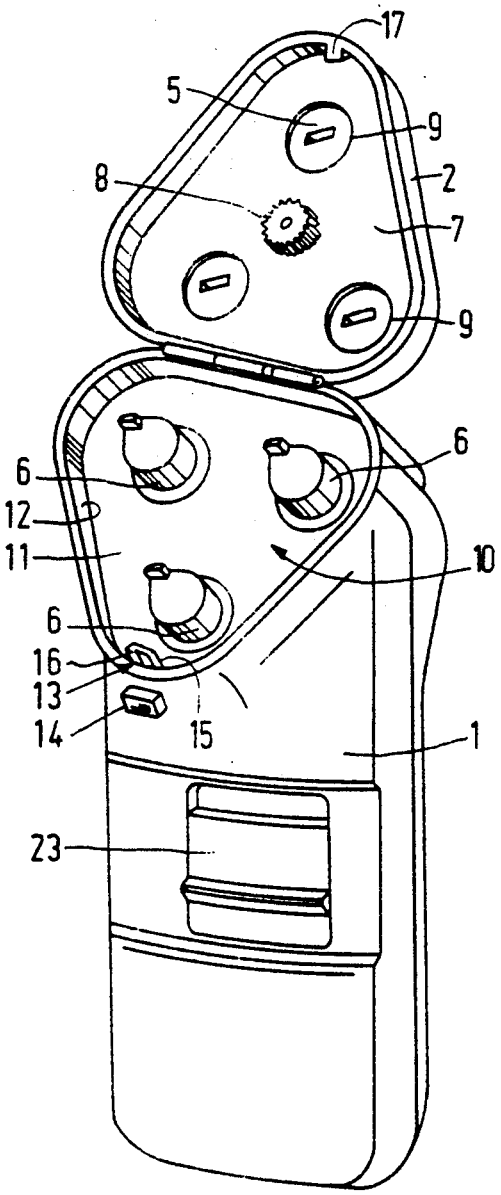
FIG. 2 shows the shaving apparatus of FIG. 1 with the collecting space opened.

The electric shaving apparatus shown in FIGS. 1 and 2 comprises a housing 1 having a holder 2 for three external shaving members 3 with hair-entry apertures 4. An internal shaving member 5 is arranged at the inner side of each external shaving member 3 and is rotatable, in a manner known per se, relative to the external shaving member 3 via a drive shaft 6 and an electric motor, not shown, in the housing I. The shaving members 3 and 5 are held in place relative to the holder 2 by means of a retaining plate. 7, which is detachably secured to the holder 2 by means of a fixing member, 8. The drive shafts 6 can be coupled to the internal shaving members 5 through openings 9 in the retaining plate 7.

Through the openings 9 hair particles severed by cooperation between the external and internal shaving members will reach the collecting space 10, which is bounded by the bottom plate 11 and the upright wall 12. The holder 2, which is hinged to the housing I, but which may for example also be completely detachable, also constitutes the closing member of the collecting space 10.

FIG. 1 illustrates the operational condition of the shaving apparatus, in which the holder 2 closes the collecting space, and FIG. 2 shows the holder in the swung-up condition to give access to the collecting space 10 for the purpose of cleaning. A locking mechanism, which in essence comprises a resilient element 13 and an actuating member 14, keeps the holder 2 in the closed position shown in FIG. 1.

Figure 3:
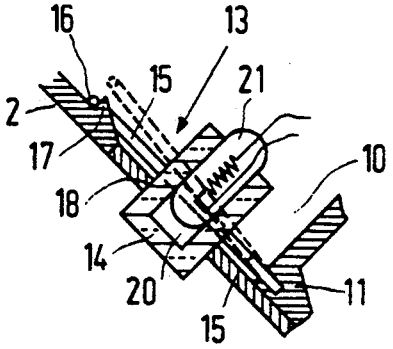
FIG. 3 is an enlarged-scale longitudinal sectional view of a part of the apparatus at the location of the actuating member.

The resilient element 13 is U-shaped and made of metal wire. The ends of the limbs 15 of the resilient element are secured in the bottom plate 11 (see also FIG. 3). In the operational condition of the shaving apparatus the transverse portion 16 of the U-shaped resilient element 13, engages behind a projection 17 on the inner side of the holder 2 to lock the holder in its closed position.

Figure 4:
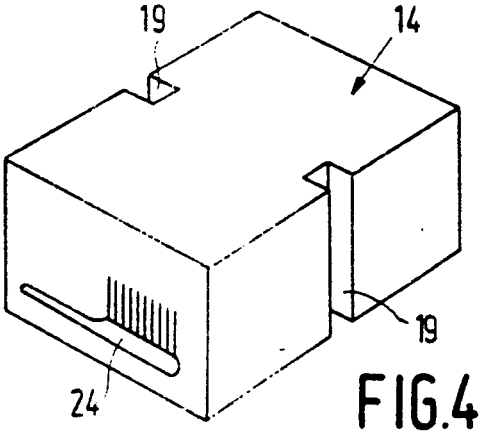
FIG. 4 is an enlarged-scale perspective view of a part of the actuating member.

The actuating member 14 is situated in an opening 18 in the upright wall 12 and projects partly from the housing 1. The part of the actuating member which is situated in the collecting space 10 is formed with two grooves 19 (FIG. 4) in which the limbs 15 of the resilient element 13 engage. When pressure is exerted on the actuating member 14 the resilient element 13 can be deflected elastically, as indicated diagrammatically in broken lines in FIG. 3, so that the transverse portion 16 is disengageable from the projection 17, thereby enabling the holder 2 to be swung open.

The actuating member 14 is made of, for example, a transparent plastics material and has an inner space 20 to accommodate an incandescent lamp or a light-emitting diode (LED).

The housing 1 also accommodates a counting mechanism 22, shown only diagrammatically, which counts the number of times that the shaving apparatus is switched on by means of the switch 23. Such a counting mechanism is also known per se, for example from U.S. Pat. No. 4,384,180.

After a number of switching cycles to be determined, for example, on the basis of practical data, the light-emitting element 21 will also be turned on the next time that the shaving apparatus is switched on. The light signal thus emitted via the actuating member 14 will warn the user of the shaving apparatus that the collecting space is to be cleaned. A new counting cycle will be started during the next shave.

Instead of in the actuating member the light-emitting element may be arranged at another location in the shaving apparatus and may be coupled to the actuating member via a an optical guide element.

Instead of by a counting mechanism the light-emitting element can be turned on by a detection device which detects the degree of soiling of the collecting space, for example on the basis of a change in electrical capacitance.

Instead of an actuating member which is wholly made of a light-transmitting material it is possible to use an actuating member having only a light-transmitting window, or to use a light-diffusing material.

Moreover, the actuating member may be provided with a symbol relating to cleaning, for example a brush 24 (FIG. 4), or with an appropriate text.

We claim:

1. An electric shaving apparatus having a housing, a switch for activating a switching cycle in which the apparatus is switched on and off, a holder for at least one external shaving member with hair-entry apertures, and an internal shaving member, the housing having a collecting space for shaving particles, which collecting space has a closing member with a locking mechanism having an actuating member for locking and unlocking the closing member, the apparatus comprising detection means for determining that cleaning of the collecting space is desirable, and a signalling device for signalling that cleaning of the collecting space is desirable, said detecting means being effective to activate said signalling means responsive to a selected or predetermined indication of soiling of the collecting space, wherein the signalling device comprises a light-emitting element in combination with the actuating member of said locking mechanism.

2. An electric shaving apparatus as claimed in claim 1, characterized in that the light-emitting element is arranged in the actuating member.

3. An electric shaving apparatus as claimed in claim 1, characterized in that the light-emitting element is coupled to the actuating member by means of an optical guide element.

4. An electric shaving apparatus as claimed in claim 3, wherein the light-emitting element is arranged in the actuating member.

5. An electric shaving apparatus as claimed in claim 1, wherein the actuating member is at least partly light-transmitting.

6. An electric shaving apparatus as claimed in claim 5, wherein the light-emitting element is arranged in the actuating member.

7. An electric shaving apparatus as claimed in claim 1, wherein the actuating member is at least partly light-diffusing.

8. An electric shaving apparatus as claimed in claim 7, wherein the light-emitting element is arranged in the actuating member.

9. An electric shaving apparatus as claimed in claim 1, wherein the actuating member is provided with a symbol relating to cleaning.

10. An electric shaving apparatus as claimed in claim 9, wherein the light-emitting element is arranged in the actuating member.

11. An electric shaving apparatus as claimed in claim 1, wherein the actuating member is provided with a text relating to cleaning.

12. An electric shaving apparatus as claimed in claim 11, wherein the light-emitting element is arranged in the actuating member.

13. An electric shaving apparatus as claimed in claim 1, wherein the light-emitting element is a LED.

14. An electric shaving apparatus as claimed in claim 13, wherein the light-emitting element is arranged int he actuating member.

15. An electric shaving apparatus having a housing, a switch for activating a switching cycle in which the apparatus is switched on and off, a holder for at least one external shaving member with hair-entry apertures, and an internal shaving member, the housing having a collecting space for shaving particles, which collecting space has a closing member with a locking mechanism having an actuating member for locking and unlocking the closing member, the apparatus comprising counting means for counting the number of switching cycles and a signalling device for signalling that cleaning of the collecting space is desirable in response to said counting means detecting a predetermined or selected number of switching cycles.

16. An electric shaving apparatus as claimed in claim 15, wherein the light-emitting element is arranged in the actuating member.

* * * * *